US011572878B2

(12) United States Patent
Kempen et al.

(10) Patent No.: US 11,572,878 B2
(45) Date of Patent: Feb. 7, 2023

(54) ELEMENT FOR COMPRESSING OR EXPANDING A GAS AND METHOD FOR CONTROLLING SUCH ELEMENT

(71) Applicants: ATLAS COPCO AIRPOWER, NAAMLOZE VENNOOTSCHAP, Wilrijk (BE); VRIJE UNIVERSITEIT BRUSSEL, Brussels (BE)

(72) Inventors: Karolien Kempen, Wilrijk (BE); Björn Verrelst, Wilrijk (BE); Philippe Ernens, Wilrijk (BE); Wouter Ceulemans, Wilrijk (BE); Guy De Greef, Wilrijk (BE); Florian Fettweis, Brussels (BE)

(73) Assignees: ATLAS COPCO AIRPOWER, NAAMLOZE VENNOOTSCHAP, Wilrijk (BE); VRIJE UNIVERSITEIT BRUSSEL, Brussels (BE)

( * ) Notice: Subject to any disclaimer, the term of this patent is extended or adjusted under 35 U.S.C. 154(b) by 0 days.

(21) Appl. No.: 17/551,429

(22) Filed: Dec. 15, 2021

(65) Prior Publication Data

US 2022/0186729 A1 Jun. 16, 2022

(30) Foreign Application Priority Data

Dec. 16, 2020 (BE) ..... 2020/5940

(51) Int. Cl.
*F04C 18/16* (2006.01)

(52) U.S. Cl.
CPC ..... *F04C 18/16* (2013.01); *F04C 2230/601* (2013.01); *F04C 2230/602* (2013.01); *F04C 2240/50* (2013.01)

(58) Field of Classification Search
CPC ..... F04C 18/16; F04C 2230/601; F04C 2230/602; F04C 2240/20; F04C 2240/30;
(Continued)

(56) References Cited

U.S. PATENT DOCUMENTS 7,614,844 B2 * 11/2009 Schofield ..... F04D 29/083 415/121.2
8,186,945 B2 * 5/2012 Bhatnagar ..... F01D 11/22 415/173.1

(Continued)

FOREIGN PATENT DOCUMENTS

JP 06-213232 A 8/1994
WO 2020/112136 A1 6/2020

*Primary Examiner* — Audrey B. Walter
*Assistant Examiner* — Dapinder Singh
(74) *Attorney, Agent, or Firm* — Sughrue Mion, PLLC

(57) ABSTRACT

An element for compressing or expanding a gas including a rigid housing (2) containing an internal chamber; a rotor (3*a*, 3*b*) situated in the internal chamber and comprising a rotor shaft (4*a*, 4*b*); one or more bearings (7) in which the rotor shaft (4*a*, 4*b*) is bearing-supported, wherein the rotor (3*a*, 3*b*) with its rotor shaft (4*a*, 4*b*) is rotatably mounted with respect to the housing (2) by means of these bearings (7), wherein the rotor (3*a*, 3*b*) is mounted with one or more clearances with respect to a wall (5) of the internal chamber, and the element (1) is provided with a separate yielding component (10) which is positionally adjustable with respect to the housing (2) in such a way that at least one of the clearances can be acted upon, wherein the separate yielding component (10) is not directly attached to the rotor (3*a*, 3*b*).

28 Claims, 6 Drawing Sheets

(58) Field of Classification Search
CPC ..... F04C 2240/50; F04C 2240/56; F04C 2270/175; F01C 21/02; F01C 21/007; F01C 1/02; F01C 1/16
See application file for complete search history.

(56) References Cited

U.S. PATENT DOCUMENTS

| | | | | |
|---|---|---|---|---|
| 8,714,951 | B2 * | 5/2014 | Yarr | F04C 2/084 418/150 |
| 10,539,137 | B2 | 1/2020 | Johnson et al. | |
| 2007/0148027 | A1 * | 6/2007 | Sommer | F04C 2/3568 417/566 |
| 2014/0105773 | A1 | 4/2014 | Tychsen | |

* cited by examiner

ELEMENT FOR COMPRESSING OR EXPANDING A GAS AND METHOD FOR CONTROLLING SUCH ELEMENT

BACKGROUND

Field

The present invention relates to an element for compressing or expanding a gas and a method for controlling such an element.

More specifically, the invention relates to an element having a rigid housing containing an internal chamber and a rotor situated in the internal chamber, the rotor being mounted with one or more clearances with respect to a wall of the internal chamber, and the element being provided with a separate yielding component which is positionally adjustable with respect to the housing in such a way that at least one of the clearances can be acted upon.

Related Art

From the prior art, elements are known where a gas can be compressed or expanded between an input and an output of the element by the rotation of one or more rotors in a housing, an internal chamber in the housing being divided by the rotors into multiple, practically mutually closed-off operating chambers, which are at a different pressure and move from the input to the output by rotation of the rotors.

In this case, the rotors are mounted in the internal chamber with one or more clearances with respect to a wall of the internal chamber and/or with respect to each other for avoiding mechanical contact between the rotors and the wall of the internal chamber and/or between the rotors mutually. This mechanical contact can, after all, lead to excessive mechanical stresses in the rotors or the housing, resulting in damage of the element.

These clearances must, on the one hand, not be too large to avoid excessive leakage streams between the operating chambers, which leakage streams reduce the efficiency of the element.

On the other hand, the clearances cannot always be or remain decreased to a desired minimum due to:

- machining tolerances for components of the element;
- thermal expansion of components of the element during operation of the element;
- vibration behavior of the rotors during operation of the element;
- mechanical load of components of the element during operation of the element as a result of compression forces on the one or more rotors, combined with excessive bearing compression and bending of the rotors;
- wear or dirt deposition on surfaces of the components of the element over time.

'During operation of the element' in this context means that the element is in an operational state in which the rotors of the element rotate.

In addition, the desired size of the clearances depends on different operating conditions of the element.

Upon startup of the element, when a temperature of the element is relatively low compared to nominal operating conditions, relatively large clearances can provide mechanical stability to the element.

In an element operating in a free-running condition, in which the element still rotates but does not have to deliver or consume any or hardly any power to or from the gas, relatively large clearances are also desirable to limit such delivered or consumed power in comparison with an element in full-load condition.

In an element operating in a speed regime in which increased vibrations at a resonant frequency of the rotor(s) and/or bearings are induced, large clearances are also desirable to provide mechanical stability to the element.

During nominal operating conditions, when a temperature of the element is relatively high with respect to the temperature during startup of the element, relatively small clearances can then again yield a high compression efficiency.

This created a need for a system to actively control the clearances in the element during operation of the element.

U.S. Pat. No. 10,539,137 B2 describes a compressor element comprising

- a housing with a bore;
- a helical rotor configured to be installed with a certain rotor clearance in the bore during the operation of the compressor element;
- an adjustable bearing, for example a magnetic bearing, in which the helical rotor is mounted; and
- a controller configured to control the adjustable bearing during the operation of the compressor element in such a way that the adjustable bearing moves the rotor in such a way that the rotor clearance is decreased or increased.

Bearings however, and in particular magnetic bearings, are typically rather non-robust components of the compressor element which can easily be disturbed in their operation as a result of excessive mechanical loads and possible mutual displacements between bearing parts resulting therefrom.

More in particular, a magnetic bearing has the specific disadvantage of a very low rigidity, whereby vibrations in the element as a result of gas pulsations upon compressing or expanding of the gas are only damped to a slight degree in the magnetic bearing. In the event of vibrations in the element, this can lead to significant sudden deviations between parts of the magnetic bearing and consequently the element.

Hence it is not advised to control the clearances in an element for compressing or expanding a gas on the basis of mutual positions of bearing parts.

The objective of the present invention is to provide a solution to at least one of the aforementioned and/or other disadvantages by making a robust, yet directed and flexible control of one or more clearances in an element for compressing or expanding a gas possible.

SUMMARY

To this end, the invention relates to an element for compressing or expanding a gas comprising

- a rigid housing containing an internal chamber;
- a rotor situated in the internal chamber and comprising a rotor shaft; and
- one or more bearings in which the rotor shaft of the rotor is bearing-supported, the rotor with its rotor shaft being mounted rotatably with respect to the housing by means of these bearings, wherein the rotor is mounted with one or more clearances with respect to a wall of the internal chamber, characterized in that the element is provided with a separate yielding component comprising

- a fixed part having a fixed or practically fixed position with respect to the housing; and a part which is positionally adjustable with respect to the housing, said positionally adjustable part configured to act on at least one of the clearances, the separate yielding component not being directly attached to the rotor.

In this context, a 'rigid housing' means a housing in which, under operating conditions of the element, upon deformation of the housing a deviation of a point of the housing with respect to other points of the housing remains limited to 10 μm.

In this context, a rotor shaft 'bearing-supported' in one or more bearings means that the rotor shaft is rigidly fixed in both its axial and radial directions with respect to a part of the one or more bearings which is co-rotating relative to the rotor shaft.

A 'yielding component' in this context means a component having a surface of which a point under the influence of a force on said surface, relative to an original position with respect to the housing when the force is not applied on said surface, can be moved at least 30 μm in the direction of the force without the component in this case becoming plastically deformed.

A 'separate yielding component' in this context means that the yielding component is not integrally manufactured with the housing. In other words, the separate yielding component does not form part of the housing and can be mounted or removed respectively in or out of the element separately from the housing.

In this context, 'a fixed part having a fixed or practically fixed position with respect to the housing' means that any displacement of the fixed part with respect to the housing has no significant effect on the one or more clearances.

In this context, 'a part which is positionally adjustable with respect to the housing' means that at least one point of the positionally adjustable part can shift with respect to a point of the housing.

An advantage is that by providing the separate yielding component in the rigid housing, more localized and directed action can be taken on the clearances than would be the case if the entire housing were implemented yieldingly.

Implementing the separate yielding component separately from the housing also makes it easy to combine a separate yielding component and a housing of a different material with each other, or to manufacture the separate yielding component and the housing on the basis of a different manufacturing technique.

By the action upon the clearances, an optimum balance can be established between avoiding excessive leakage streams in the element between the rotor and the wall of the internal chamber on the one hand and avoiding large mechanical stresses between the rotor and the housing at the wall of the internal chamber on the other hand.

In addition, the separate yielding component allows the clearances between the rotor and the wall of the internal chamber to be acted upon without in that case action having to be taken directly on the operation of the bearings or on mutual positions of parts in the bearings.

It is also an advantage that the separate yielding component with respect to the housing can be positionally adjusted without having to consider effects of the rotation of the rotor on the separate yielding component during operation of the element, as, for example, a centrifugal force acting upon the separate yielding component.

In a preferred embodiment of the element, a bearing of the one or more bearings is in its entirety arranged movably with respect to the housing; and the positionally adjustable part is configured to make contact with a part of said bearing which does not rotate with respect to the housing and in that case to exert a force on this non-rotating part.

In this way, the bearing in its entirety, together with the rotor, is shifted with respect to the housing.

In a following preferred embodiment of the element, the positionally adjustable part is configured to move itself respectively in or out of at least one of the clearances.

In this way, at least one of the clearances is sealed or opened by the positionally adjustable part.

In a following preferred embodiment of the invention, the element comprises multiple rotors, said multiple rotors being mounted with a mutual clearance in such a way that by the rotors multiple, practically mutually closed-off operating chambers are formed in the internal chamber, and the positionally adjustable part being configured to change the mutual clearance between the rotors in size.

An advantage in this case is that also excessive mechanical stresses and/or leakage streams between the rotors mutually can be avoided, so that the clearances can be set optimally for each operating condition of the element.

In a following preferred embodiment of the element according to the invention, the separate yielding component comprises a radial rotor positioner, configured in such a way that the rotor and the housing, with regard to the rotor shaft, can be shifted radially with respect to each other.

In this way, a radial clearance according to the rotor shaft, in the element between the rotor(s) and the wall of the internal chamber and/or between the rotors mutually, can be increased or decreased.

In a more preferred embodiment of the element according to the invention, at least one of the aforementioned bearings is a radial bearing which in its entirety is movably arranged with respect to the housing; and the radial rotor positioner comprises a first shape-changing body, said first shape-changeable body being configured to make contact with a part of the radial bearing not rotating with respect to the housing and in that case to exert a force on this non-rotating part.

In this way, the radial bearing in its entirety, together with the rotor, is shifted with respect to the housing.

In a following preferred embodiment of the element according to the invention, the separate yielding component comprises an axial rotor positioner, configured in such a way that the rotor and the housing, with regard to the rotor shaft, can be shifted axially with respect to each other.

In this way, an axial clearance according to the rotor shaft, in the element between the rotor and the wall of the internal chamber, can be increased or decreased.

If the element comprises multiple rotors, the mutual clearance between the rotors can also be changed in size by the axial displacement according to its rotor shaft of one of said multiple rotors with respect to the housing.

In a more preferred embodiment of the element according to the invention, at least one of the aforementioned bearings is an axial bearing which in its entirety is movably arranged with respect to the housing; and the axial rotor positioner comprises a second shape-changeable body, the second shape-changeable body being configured to make contact with a part of the axial bearing which is not rotating with respect to the housing and in that case to exert a force on this non-rotating part.

In this way, the axial bearing in its entirety, together with the rotor, is shifted with respect to the housing.

In a following preferred embodiment of the element according to the invention, the separate yielding component comprises a radially adaptable ring body surrounding the rotor shaft, an outer perimeter of the radially adaptable ring body being fixedly attached with respect to the housing and the radially adaptable ring body being configured in such a way that an external inner radius, radial according to the rotor shaft, of the radially adaptable ring body can be changed in size.

By decreasing or increasing said external inner radius of the radially adaptable ring body, a radial clearance according to the rotor shaft, in the element between the rotor shaft and the housing, can be respectively sealed or opened by the radially adaptable ring body.

In a following preferred embodiment of the element according to the invention, the internal chamber comprises a bore according to a direction of the rotor shaft.

In a more preferred embodiment of this element, the separate yielding component comprises an axially adaptable body which is attached to an end face of the bore, which axially adaptable body has a first specific deformable shape configured to be capable of sealing or opening an axial clearance according to the rotor shaft between the rotor and the end face in such a way that a first operating chamber in the internal chamber can be respectively isolated from or placed in fluid communication with a second operating chamber in the internal chamber.

In a following more preferred embodiment of this element, the separate yielding component comprises a radially adaptable body attached to a surface of revolution of the bore, which radially adaptable body has a second specific deformable shape configured to be capable of sealing or opening a radial clearance according to the rotor shaft between the rotor and the surface of revolution in such a way that a third operating chamber in the internal chamber can be respectively isolated from or placed in fluid communication with a fourth operating chamber in the internal chamber.

In a following preferred embodiment of the invention, the element comprises mechanical, hydraulic and/or pneumatic means for positionally adjusting the positionally adjustable part with respect to the housing.

An advantage is that such mechanical, hydraulic and/or pneumatic means are mechanically robust, and that yielding components which are positionally adjusted by such mechanical, hydraulic and/or pneumatic means can withstand higher mechanical loads than yielding components which are positionally adjusted by, for example, (electro) magnetic means, as is the case with a magnetic bearing.

A further advantage is that a movement of mechanical means or a pressure for driving hydraulic or pneumatic means can be accurately controlled, in all respects more accurate than, for example, a temperature for driving thermal means which could cause a thermal expansion or contraction of the positionally adjustable part of the separate yielding component.

In a following preferred embodiment of the invention, the element comprises a controller for driving the positionally adjustable part.

With the aid of a such controller, one or more of the clearances can automatically be acted upon without requiring manual intervention by a human operator on the element.

The invention relates to a device for compressing or expanding a gas comprising an element according to one of the above-described embodiments.

It goes without saying that a such device offers the same advantages as an element according to one of the previously described embodiments.

Further, the invention also relates to a separate yielding component for use in an element according to one of the above-described embodiments or according to the above-described device.

Furthermore, the invention also relates to a method for controlling an element for compressing or expanding a gas, the element comprising a rigid housing containing an internal chamber;

a rotor situated in the internal chamber and comprising a rotor shaft; and one or more bearings in which the rotor shaft of the rotor is bearing-supported, the rotor with its rotor shaft being mounted rotatably with respect to the housing by means of these bearings, wherein the rotor is mounted with one or more clearances with respect to a wall of the internal chamber, characterized in that the method comprises the step of acting upon at least one of the clearances by positionally adjusting a positionally adjustable part of a separate yielding component of the element with respect to the housing, wherein a fixed part of the separate yielding component is held in a fixed or practically fixed position with respect to the housing, and wherein this separate yielding component is not directly attached to the rotor.

It goes without saying that a such device offers the same advantages as an element according to one of the previously described embodiments.

In a preferred embodiment of the method according to the invention, at least one of the one or more clearances is controlled when the element is in operation.

An advantage in this case is that during operation the clearances can be controlled based on the operating conditions of the element, and thus an optimum balance can be set between avoiding excessive leakage streams in the element on the one hand and avoiding large mechanical stresses between the rotor and the housing at the wall of the internal chamber on the other hand.

BRIEF DESCRIPTION OF THE DRAWINGS

With the intention to better demonstrate the characteristics of the invention, some preferred embodiments, by way of example without any limiting character, are hereafter described of an element according to the invention for compressing or expanding a gas, with reference to the accompanying drawings, in which.

DETAILED DESCRIPTION

The terminology used is intended only to describe the preferred embodiments by way of example and must not be interpreted as limiting for the scope of protection as defined in the claims.

Terms in the singular, preceded by 'a' or 'the', may also designate these terms in plural form.

Although the terms "first", "second", "third", "fourth", or "fifth" are used in the following for designating different shape-changeable bodies, cavities, pressures, or operating chambers, these shape-changeable bodies, cavities, pressures or operating chambers are not limited by these terms. At most, these terms have only been used to distinguish a type of shape-changeable body, cavity, pressure, or operating chamber. When terms such as "first", "second", "third", "fourth", or "fifth" are used in the following, these terms do not imply any particular sequence or order. Consequently, a first shape-changeable body, cavity, pressure or operating chamber could just as easily be designated as, for example, a second or third shape-changeable body, cavity, pressure, or operating chamber without in that case going beyond the scope of the example embodiments. It should also be mentioned that there may be multiple first, second, third, fourth or fifth shape-changeable bodies, cavities, pressures, or operating chambers.

Figure 1:
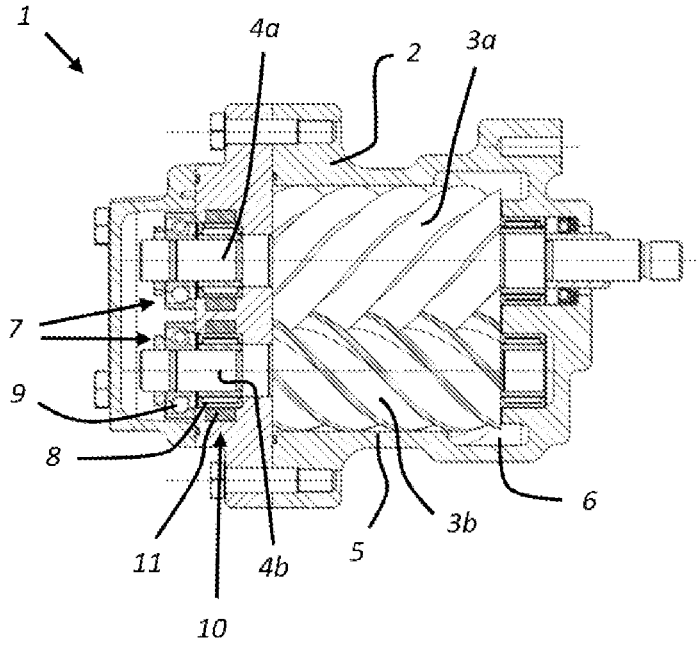
FIG. 1 shows a cross section of a first embodiment of an element according to the invention.

FIG. 1 shows an element 1 according to the invention for compressing a gas.

Said element 1 comprises a rigid housing 2 containing an internal chamber. Said housing 2 is in this case implemented in several parts, which can easily be mutually assembled or disassembled for respectively placing or removing a rotor 3*a*, 3*b* in the internal chamber.

In the element 1 in FIG. 1, there are two rotors 3*a*, 3*b* each having a rotor shaft 4*a*, 4*b* in the internal chamber. The two rotors 3*a*, 3*b* are in this case implemented as two intermeshing helical rotors mounted with clearances with respect to a wall 5 of the internal chamber and with respect to each other, whereby the internal chamber is subdivided by the helical rotors into multiple operating chambers mutually closed off except for clearances.

By the rotation of the rotors 3*a*, 3*b*, gas will be sucked in from an inlet port 6 to and into an operating chamber connected to this inlet port 6 in the internal chamber. By further rotation of the rotors 3*a*, 3*b*, this operating chamber will, with regard to the rotor shaft 4*a*, 4*b*, move axially away from the inlet port 6 and be closed off from the inlet port 6, after which, upon further rotation of the rotors 3*a*, 3*b*, the sucked-in gas in the operating chamber will be compressed.

This implies that in axially successive operating chambers, with regard to the rotor shaft 4*a*, 4*b*, from the inlet port 6, the sucked-in gas in the internal chamber is compressed at an ever increasing pressure.

Due to a difference in pressure between the said successive operating chambers, leakage streams of gas occur via the clearances in the direction of the inlet port 6.

The rotor shafts 4*a*, 4*b* of the rotors 3*a*, 3*b* are supported in bearings 7, whereby the rotors 3*a*, 3*b* with their rotor shaft 4*a*, 4*b* are rotatably mounted with respect to the housing 2 by means of bearings 7.

The bearings 7 can be implemented as:

- a radial bearing 8 capable of absorbing a mechanical load radial with regard to the rotor shaft 4*a*, 4*b*; and/or
- an axial bearing 9 capable of absorbing a mechanical load axial with regard to the rotor shaft 4*a*, 4*b*.

Although the bearings 7 in FIG. 1 are situated around an end of the rotor shaft 4*a*, 4*b* situated farthest from the inlet port 6 of the element, it is not excluded within the scope of the invention that the bearings 7 are situated at an end of the rotor shaft 4*a*, 4*b* at the inlet port 6.

Without any preference, the element 1 is in this case an oil-injected compressor element.

It is not excluded or advised against within the scope of the invention that the element is a compressor element without oil injection in the internal chamber, wherein rotations of rotors in the internal chamber are synchronized, for example by means of intermeshing gear wheels on the rotor shafts of these rotors.

It is also not excluded within the scope of the invention that the element is an element for the expanding a gas.

For acting upon at least one of the clearances, the housing 2 is provided with at least one separate yielding component 10 which is positionally adjustable with respect to the housing 2.

With 'acting upon at least one of the clearances' is meant that, by means of the separate yielding component 10, a smallest cross section of a clearance between a rotor 3*a*, 3*b* and the wall 5 of the internal chamber or between the rotors 3*a*, 3*b* mutually is either

- decreased or increased; and/or
- sealed or opened.

In the case of the element 1 in FIG. 1, the separate yielding components 10 are implemented as a radial rotor positioner 11, which radial rotor positioner 11 is capable of radially shifting the rotor 3*a*, 3*b* and the housing 2 according to the rotor shaft 4*a*, 4*b* with respect to each other.

Figure 2:
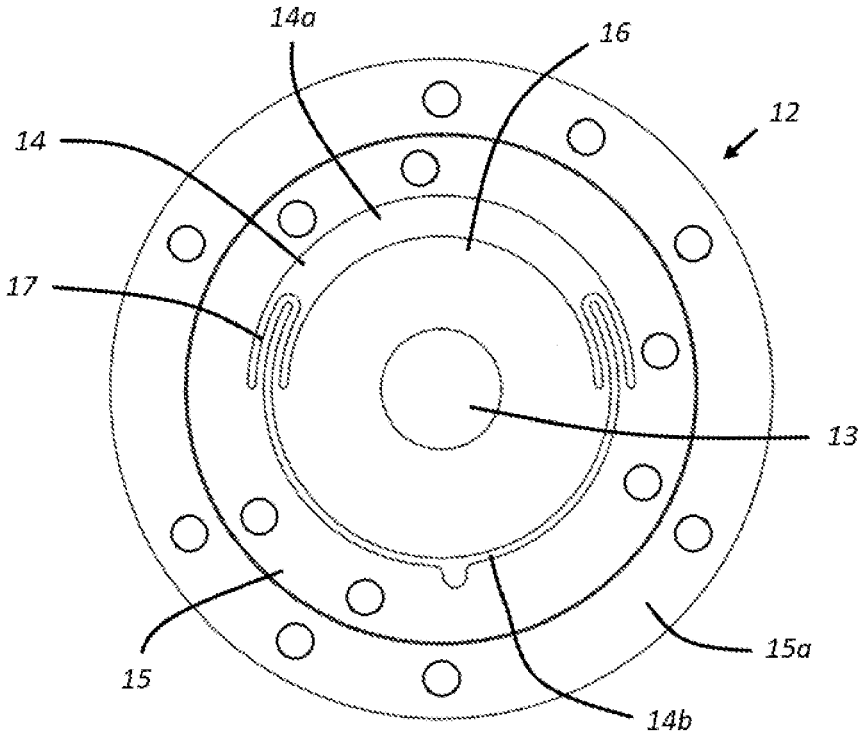
FIG. 2 shows a piece of a first separate yielding component in the element of FIG. 1 in more detail.

FIG. 2 shows a more detailed and concrete example of a piece of such a radial rotor positioner 11.

The radial rotor positioner 11 comprises a first shape-changeable body 12 having a through-hole 13.

In the through-hole 13, a non-rotating part with respect to the housing of one of the bearings 7, which in this case should be a radial bearing 8, should be firmly fixed.

Further, the first shape-changeable body 12 encloses several of the first cavities 14 closed off or practically closed off from the internal chamber, which first cavities 14 are each at a separate first pressure, wherein in a plane perpendicular to the rotor shaft 4*a*, 4*b* a first 14*a* of said first cavities 14 is situated directly opposite at least one second 14*b* of these first cavities 14 with respect to the rotor shaft 4*a*, 4*b*.

The first shape-changeable body 12 is configured in such a way and is controlled in such a way that, when a first pressure in the first 14*a* of the first cavities 14 is increased,

- a volume of said first 14*a* of the first cavities 14 increases; and
- the first pressure in the at least one second 14*b* of the first cavities 14 is decreased in such a way that a volume of the at least one second 14*b* of the first cavities 14 decreases, so that the radial bearing 8 together with the rotor 3*a*, 3*b* is shifted with respect to the housing 2 in a relative to the rotor shaft 4*a*, 4*b* radial direction to the at least one second 14*b* of the first cavities 14.

More specifically, the radial rotor positioner 11 comprises an outer ring 15, an inner ring 16 and a space, closed off or practically closed off from the internal chamber, between the outer ring 15 and the inner ring 16.

In this case, the outer ring 15 is fixedly attached with respect to the housing 2, for example by a flange 15*a* that is part of the outer ring 15, while the inner ring 16 is fixedly attached to a non-rotating part with respect to the housing 2 of the radial bearing 8.

It is not excluded in this case within the scope of the invention that the outer ring 15 is fixedly attached to a non-rotating part with respect to the housing 2 of the radial bearing 8, while the inner ring 16 is fixedly attached to the housing 2.

The radial rotor positioner 11 is in this case provided with a spring structure 17 in the aforementioned space between the outer ring 15 and the inner ring 16, which spring structure 17 is connected with the outer ring 15 on the one hand and with the inner ring 16 on the other hand. In this way, the aforementioned space is subdivided into multiple mutually separated essentially ring segment-shaped compartments, each of these compartments serving as one of the aforementioned first cavities 14.

Each of these compartments can be provided with a connection point (not shown in FIG. 1 or 2) for supplying or discharging an operational fluid to increase or decrease the initial pressure in each of the compartments, respectively.

The radial rotor positioner piece as shown in FIG. 2 also includes disc-shaped sealing plates (not shown in FIG. 2), which, according to the rotor shaft 4*a*, 4*b*, are axially attached to both sides of the outer ring 15 and serve to seal off the space between the outer ring 15 and the inner ring 16 according to the rotor shaft 4*a*, 4*b* axially from the internal chamber.

Figure 3:
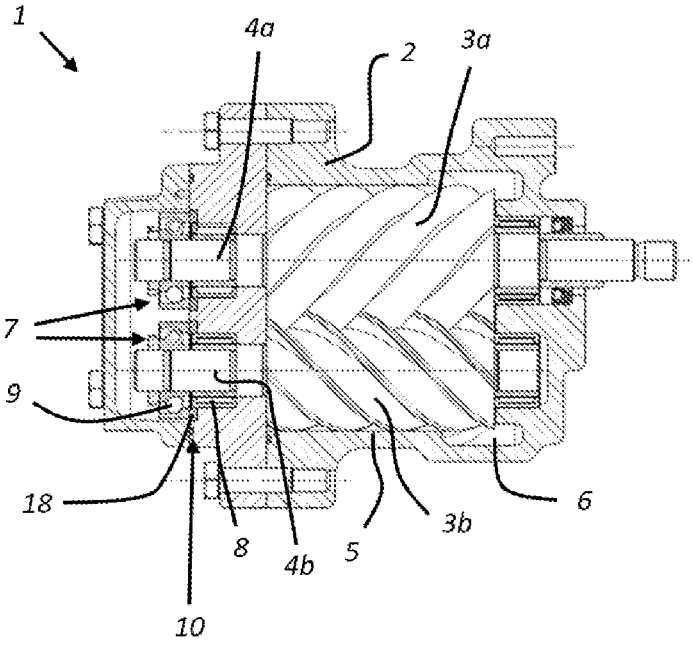
FIG. 3 shows a cross section of a second alternative embodiment of the element according to the invention.

FIG. 3 shows a second alternative embodiment of the element 1 according to the invention.

In the case of the element 1 in FIG. 3, the separate yielding components 10 are implemented as an axial rotor positioner 18, which axial rotor positioner 18 is capable of shifting the rotor 3*a*, 3*b* and the housing 2 axially according to the rotor shaft 4*a*, 4*b* with respect to each other.

The axial rotor positioner 18 is situated between the housing 2 and a non-rotating part with respect to the housing 2 of at least one of the bearings 7, which in this case should be an axial bearing 9.

Figure 4:
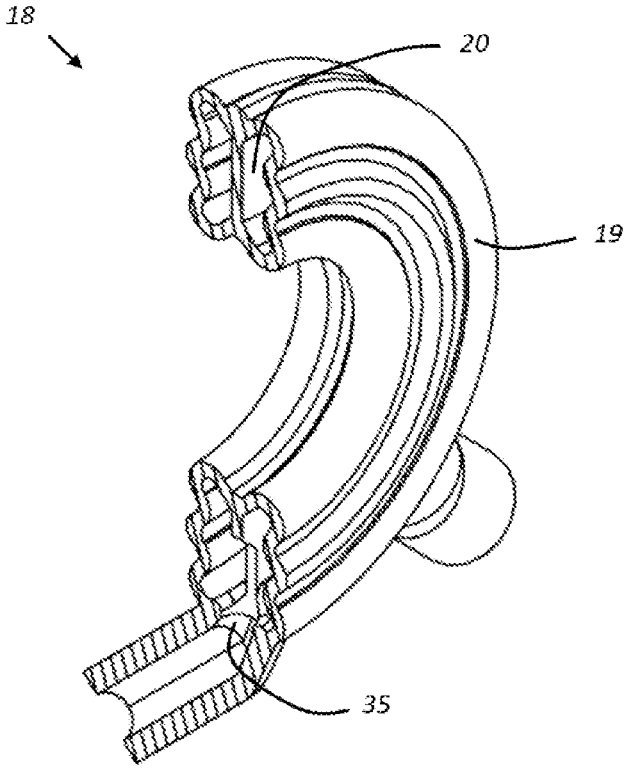
FIG. 4 shows a second separate yielding component in the element of FIG. 3 in a sectioned view in more detail.

FIG. 4 shows a more detailed and concrete example of such an axial rotor positioner 18.

The axial rotor positioner 18 comprises a second shape-changeable body 19 that encloses a second cavity 20 closed off or practically closed off from the internal chamber.

In this case, the second shape-changeable body 19 is configured and controlled in such a way that an axial dimension according to the rotor shaft 4*a*, 4*b* of the second shape-changeable body 19 increases or decreases by increasing or decreasing a second pressure in the second cavity 20, respectively.

To this end, the second shape-changeable body 19 can be provided with a connection point 35 for supplying or discharging an operational fluid to increase or decrease the second pressure in the second cavity 20, respectively.

By increasing the axial dimension of the second shape-changeable body 19, the second shape-changeable body 19 shifts the axial bearing 9 together with the rotor 3*a*, 3*b* in an axial direction according to the rotor shaft 4*a*, 4*b* with respect to the housing 2. Upon retrospectively decreasing the axial dimension of the second shape-changeable body 19, the axial bearing 9 and the rotor 3*a*, 3*b* can return to their original position axially according to the rotor shaft 4*a*, 4*b*.

In this way, an axial clearance according to the rotor shaft 4*a*, 4*b* between the rotor 3*a*, 3*b* and the housing 2 can be increased or decreased.

Figure 5:
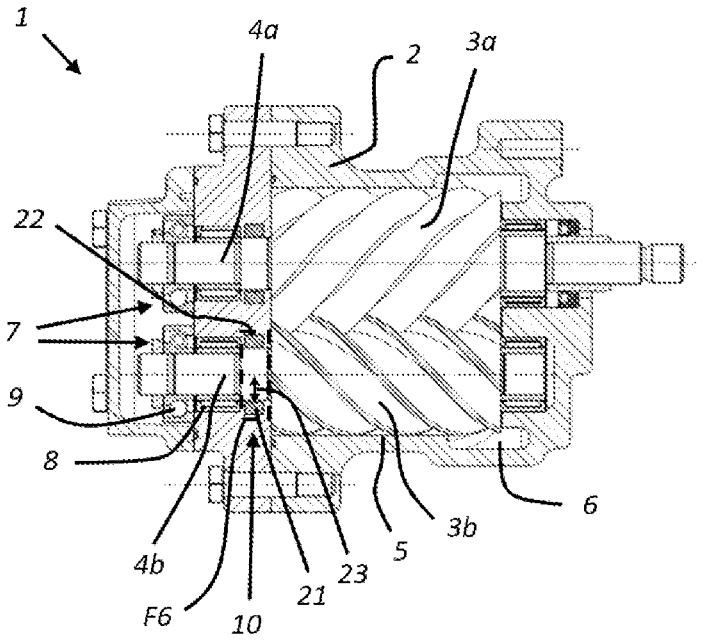
FIG. 5 shows a cross section of a third alternative embodiment of the element according to the invention.

FIG. 5 shows a third alternative embodiment of the element 1 according to the invention.

In the case of the element 1 in FIG. 5, the separate yielding components 10 are implemented as a radially adaptable ring body 21 surrounding the rotor shaft 4*a*, 4*b*. An outer perimeter 22 of the radially adaptable ring body 21 is fixedly attached with respect to the housing 2. Further, the radially adaptable ring body 21 is configured in such a way that a radial external inner radius 23 according to the rotor shaft 4*a*, 4*b* of the radially adaptable ring body 21 can be changed in size.

With 'a radial external inner radius according to the rotor shaft of the radially adaptable ring body' a straight radius is meant

- situated in a plane perpendicular to the rotor shaft 4*a*, 4*b;*
- of which a first end point is situated on the rotor shaft 4*a*, 4*b;*
- of which a second end point is a point of the radially adaptable ring body 21; and
- of which each point between the first end point and the second end point is not a point of the radially adaptable ring body 21.

Figure 6:
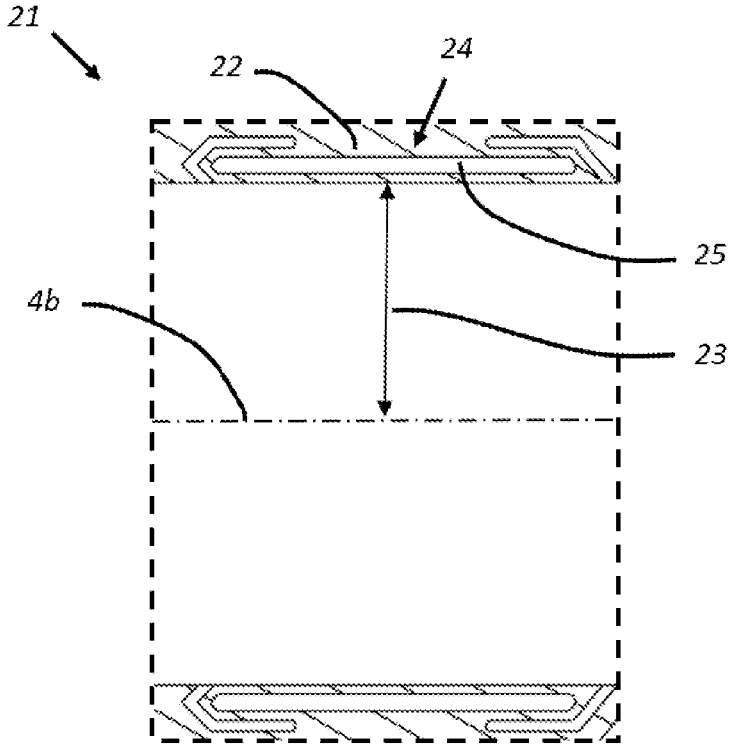
FIG. 6 shows in more detail the part designated in FIG. 5 as F6, which part shows a third separate yielding component in the element of FIG. 5 in sectioned view.

FIG. 6 shows a more detailed and concrete example of the radially adaptable ring body 21.

The radially adaptable ring body 21 comprises a ring-shaped third shape-changeable body 24 that encloses a third cavity 25 closed off or practically closed off from the internal chamber.

Said third shape-changeable body 24 is configured in such a way that the radial external inner radius 23 according to the rotor shaft 4*a*, 4*b* decreases or increases by increasing or decreasing a third pressure in the third cavity 25, respectively.

To this end, the third shape-changeable body 24 can be provided with a connection point (not shown in FIG. 5 or 6) for supplying or discharging an operational fluid to increase or decrease the third pressure in the third cavity 25, respectively.

By decreasing the radial external inner radius 23, the radially adaptable ring body 21 expands radially inwards around the rotor shaft 4*a*, 4*b* according to the rotor shaft 4*a*, 4*b*. Upon increasing the radial external inner radius 23 retrospectively, the radial distance according to the rotor shaft 4*a*, 4*b* between the radially adaptable ring body 21 and the rotor shaft 4*a*, 4*b* increases retrospectively.

In this way, a radial clearance according to the rotor shaft 4*a*, 4*b* between the rotor shaft 4*a*, 4*b* and the housing 2 can be respectively decreased or increased.

Figure 7:
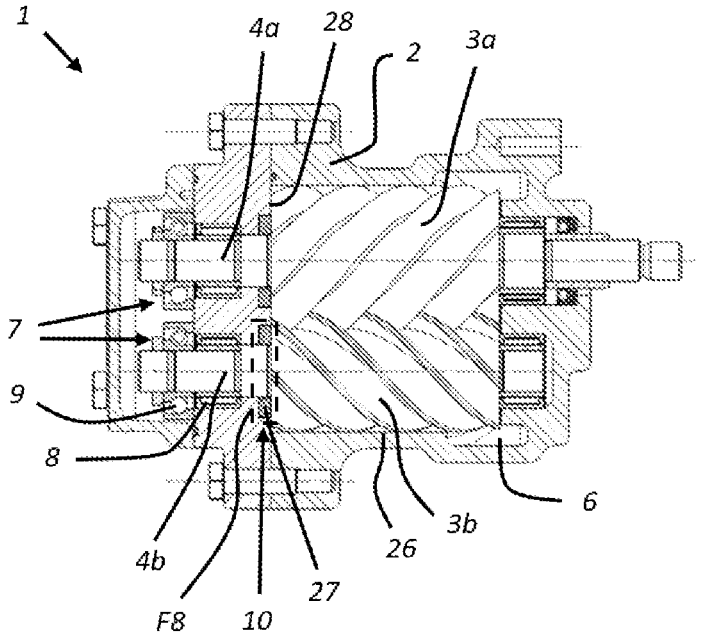
FIG. 7 shows a cross section of a fourth alternative embodiment of the element according to the invention.

FIG. 7 shows a fourth alternative embodiment of the element 1 according to the invention.

The internal chamber comprises a bore 26 according to a direction of the rotor shaft 4*a*, 4*b*.

In the case of the element 1 in FIG. 7, the separate yielding components 10 are implemented as an axially adaptable body 27 which is attached to an end face 28 of the bore 26.

This axially adaptable body 27 has a first specific deformable shape configured to be capable of sealing or opening an axial clearance according to the rotor shaft 4*a*, 4*b* between the rotor 3*a*, 3*b* and the end face 28 in such a way that a first operating chamber in the internal chamber can be respectively isolated from or placed in fluid communication with a second operating chamber in the internal chamber.

Although the end surface 28 in FIG. 7 is situated at a side of the bore 26 farthest from the inlet port 6 of the element, it is not excluded within the scope of the invention that the end surface is situated at a side of the bore 26 at the inlet port 6.

Figure 8:
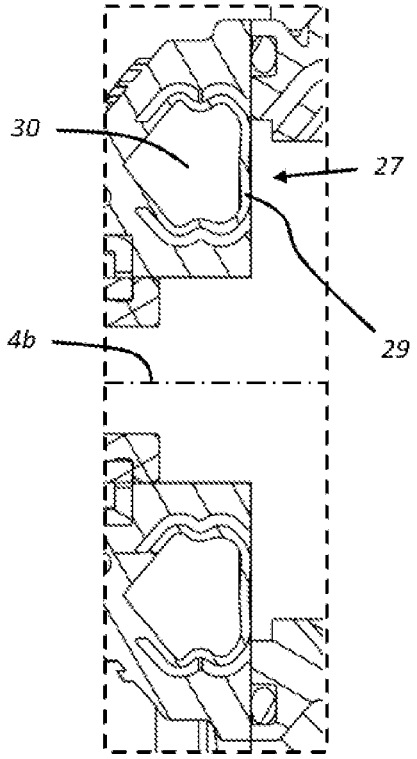
FIG. 8 shows in more detail the part designated in FIG. 7 as F8, which part shows a fourth separate yielding component in the element of FIG. 7 in sectioned view.

FIG. 8 shows a more detailed and concrete example of the axially adaptable body 27.

The axially adaptable body 27 comprises a fourth shape-changeable body 29 that encloses a fourth cavity 30 closed off or practically closed off from the internal chamber.

This fourth shape-changeable body 29 is configured in such a way that an axial dimension according to the rotor shaft 4*a*, 4*b* of the fourth shape-changeable body 29 increases or decreases by increasing or decreasing a fourth pressure in the fourth cavity 30, respectively.

To this end, the fourth shape-changeable body 29 can be provided with a connection point (not shown in FIG. 7 or 8) for supplying or discharging an operational fluid to increase or decrease the fourth pressure in the fourth cavity 30, respectively.

By increasing the axial dimension according to the rotor shaft 4*a*, 4*b* of the fourth shape-changeable body 29, the fourth shape-changeable body 29 increases towards the rotor 3*a*, 3*b* in an axial direction according to the rotor shaft 4*a*, 4*b*. As a result, an axial clearance according to the rotor shaft 4*a*, 4*b* between the rotor 3*a*, 3*b* and the housing 2 can be sealed in such a way that the aforementioned first operating chamber in the internal chamber can be isolated from the aforementioned second operating chamber in the internal chamber.

Upon retrospectively decreasing of the axial dimension according to the rotor shaft 4*a*, 4*b* of the fourth shape-changeable body 29, the fourth shape-changeable body 29 of the rotor 3*a*, 3*b* decreases away in an axial direction according to the rotor shaft 4*a*, 4*b*. As a result, the axial clearance according to the rotor shaft 4*a*, 4*b* between the rotor 3*a*, 3*b* and the housing 2 is retrospectively opened in such a way that the aforementioned first operating chamber in the internal chamber is retrospectively placed in fluid communication with the aforementioned second operating chamber in the internal chamber.

It is not excluded within the scope of the invention that, in the case of the element comprising multiple rotors, a clearance between the end face on the one hand and both rotors on the other hand can be sealed or opened by means of a same axially adaptable body.

Figure 9:
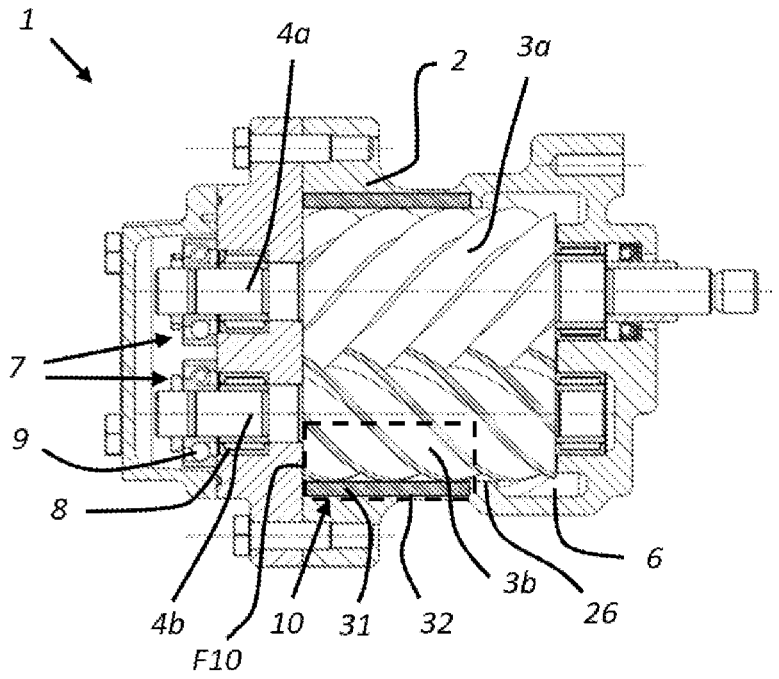
FIG. 9 shows a cross section of a fifth alternative embodiment of the element according to the invention.

FIG. 9 shows a fifth alternative embodiment of the element 1 according to the invention.

In this fifth embodiment, the internal chamber also comprises the bore 26 according to a direction of the rotor shaft 4*a*, 4*b*.

In the case of the element 1 in FIG. 9, the separate yielding components 10 are implemented as a radially adaptable body 31 attached to a surface of revolution 32 of the bore 26.

Said radially adaptable body 31 has a second specific deformable shape configured to be able to seal or open a radial clearance according to the rotor shaft 4*a*, 4*b* between the rotor 3*a*, 3*b* and the surface of revolution 32 in such a way that a third operating chamber in the internal chamber can be respectively isolated from or placed in fluid communication with a fourth operating chamber in the internal chamber.

Figure 10:
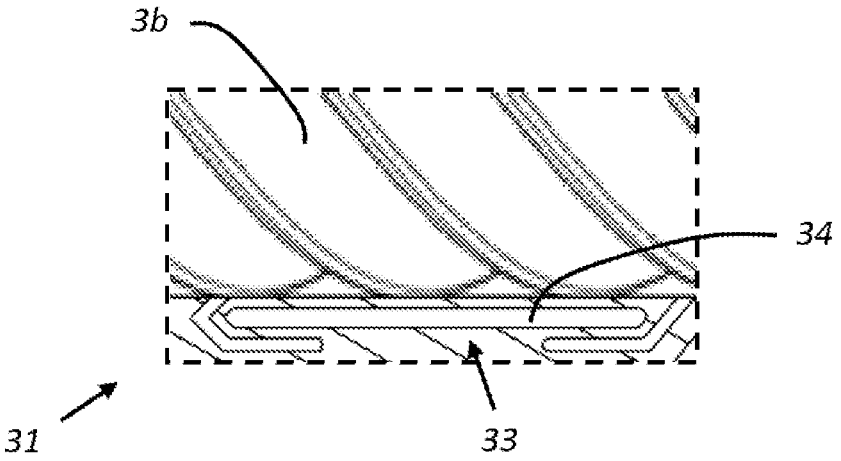
FIG. 10 shows in more detail the part designated in FIG. 9 as F10, which part shows a fifth separate yielding component in the element of FIG. 9 in sectioned view.

FIG. 10 shows a more detailed and concrete example of the radially adaptable body 31.

The radially adaptable body 31 comprises a fifth shape-changeable body 33 that encloses a fifth cavity 34 closed off or practically closed off from the internal chamber.

Said fifth shape-changeable body 33 is configured in such a way that a radial dimension according to the rotor shaft 4*a*, 4*b* of the fifth shape-changeable body 33 increases or decreases by increasing or decreasing a fifth pressure in the fifth cavity 34, respectively.

To this end, the fifth shape-changeable body 33 can be provided with a connection point (not shown in FIG. 9 or 10) for supplying or discharging an operational fluid to increase or decrease the fifth pressure in the fifth cavity 34, respectively.

By increasing the radial dimension according to the rotor shaft 4*a*, 4*b* of the fifth shape-changeable body 33, the fifth shape-changeable body 33 increases towards the rotor 3*a*, 3*b* in a relative to the rotor shaft 4*a*, 4*b* radial direction. As a result, a radial clearance according to the rotor shaft 4*a*, 4*b* between the rotor 3*a*, 3*b* and the housing 2 can be sealed in such a way that the aforementioned third operating chamber in the internal chamber can be isolated from the aforementioned fourth operating chamber in the internal chamber.

Upon retrospectively decreasing the radial dimension according to the rotor shaft 4*a*, 4*b* of the fifth shape-changeable body 33, the fifth shape-changeable body 33 of the rotor 3*a*, 3*b* decreases away in a relative to the rotor shaft 4*a*, 4*b* radial direction. As a result, the radial clearance according to the rotor shaft 4*a*, 4*b* between the rotor 3*a*, 3*b* and the housing 2 is retrospectively opened in such a way that the aforementioned third operating chamber in the internal chamber is retrospectively placed in fluid communication with the aforementioned fourth operating chamber in the internal chamber.

It is not excluded within the scope of the invention that, in the case of the element comprising multiple rotors, by means of a same radially adaptable body a clearance between the surface of revolution of the bore on the one hand and both rotors on the other hand can be sealed or opened.

Figure 11:
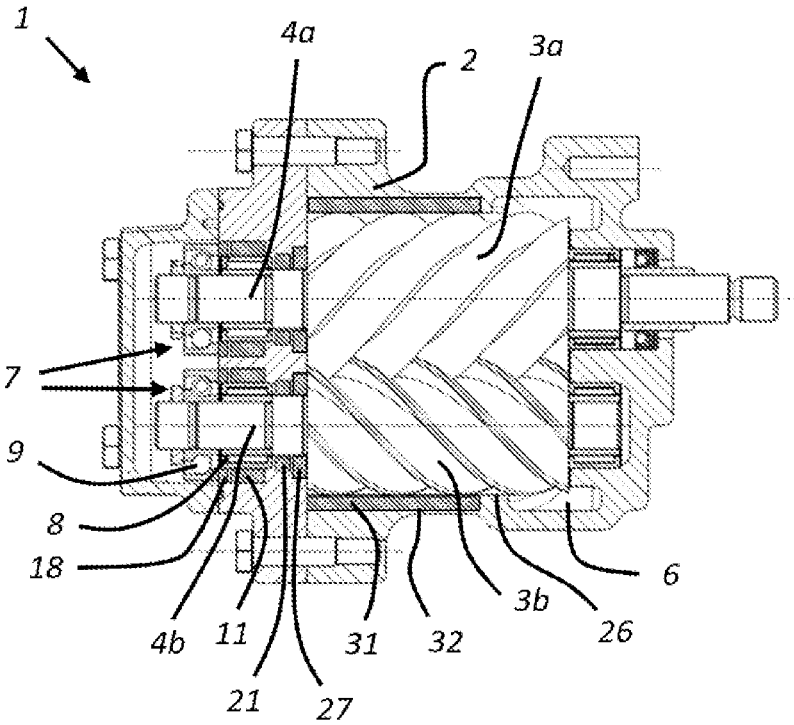
FIG. 11 shows a cross section of a sixth alternative embodiment of the element according to the invention.

FIG. 11 shows a sixth alternative embodiment of the element 1 according to the invention.

In said sixth alternative embodiment, the housing 2 is provided with all above-described different types of separate yielding components 10.

Said element 1 can also comprise mechanical, hydraulic and/or pneumatic means for positionally adjusting the separate yielding components 10, as, for example, a mechanical actuator or a hydraulic or pneumatic circuit.

Further, the element 1 can also comprise a controller for driving the separate yielding components 10.

The clearances can be controlled when the element 1 is not in operation and/or be controlled on a predefined value before the element 1 is put into operation.

The clearances can also be controlled when said element 1 is in operation.

Control of the clearances can take place on the basis of:

a performance measurement of the element 1;

vibration measurements; and/or direct measurement of the clearances.

It is of course not excluded within the scope of the invention that the housing 2 is provided with only some of these different types of separate yielding components 10.

It is also not excluded within the scope of the invention that a separate yielding component combines several of the technical characteristics or functionalities of the previously described separate yielding components 10 in an integrated manner.

It is further not excluded that the element 1 is not a screw compressor element. Other possibilities are, for example, a screw blower element, a screw vacuum pump element, a screw expander element, a tooth compressor element, a tooth blower element, a tooth vacuum pump element, a tooth expander element, a roots compressor element, a roots blower element, a roots vacuum pump element, a roots expander element, a turbo compressor element, a turbo blower element, a turbo vacuum pump element or a turbo expander element.

The present invention is by no means limited to the embodiments described by way of example and shown in the figures, yet an element according to the invention for compressing or expanding a gas can be realized in several variants, forms and dimensions without going beyond the scope of the invention as defined in the claims.

The invention claimed is:

1. An element for compressing or expanding a gas comprising:

a rigid housing (2) containing an internal chamber;

a rotor (3*a*, 3*b*) situated in the internal chamber and comprising a rotor shaft (4*a*, 4*b*);

one or more bearings (7) in which the rotor shaft (4*a*, 4*b*) of the rotor (3*a*, 3*b*) is bearing-supported, the rotor (3*a*, 3*b*) with its rotor shaft (4*a*, 4*b*) being rotatably mounted with respect to the housing (2) by means of these bearings (7), wherein the rotor (3*a*, 3*b*) is mounted with one or more clearances with respect to a wall (5) of the internal chamber, wherein the element (1) includes a separate yielding component (10) comprising:

a fixed part having a fixed or practically fixed position with respect to the housing (2); and a positionally adjustable part with respect to the housing (2), said positionally adjustable part configured to act on at least one of the clearances, the separate yielding component (10) is not directly attached the rotor (3*a*, 3*b*).

2. The element according to claim 1, wherein a bearing of the one or more bearings (7) is movably arranged in its entirety with respect to the housing (2); and that the positionally adjustable part is configured to make contact with a non-rotating part of said bearing with respect to the housing (2) and in that case to exert a force on this non-rotating part, in such a way that the bearing in its entirety together with the rotor (3*a*, 3*b*) is shifted with respect to the housing (2).

3. The element according to claim 1, wherein the positionally adjustable part is configured to move itself respectively in or out of at least one of the clearances, in such a way that the at least one of the clearances is sealed or opened by the positionally adjustable part.

4. The element according to claim 1, wherein the element (1) comprises multiple rotors (3*a*, 3*b*), said multiple rotors (3*a*, 3*b*) being mounted with a mutual clearance in such a way that by the rotors (3*a*, 3*b*) multiple, practically mutually closed-off operating chambers are formed in the internal chamber, and the positionally adjustable part being configured to change the mutual clearance in size.

5. The element according to claim 1, wherein the separate yielding component (10) comprises a radial rotor positioner (11), configured in such a way that the rotor (3*a*, 3*b*) and the housing (2), with respect to the rotor shaft (4*a*, 4*b*), can be shifted radially relative to each other.

6. The element according to claim 5, wherein at least one of the aforementioned bearings (7) is a radial bearing (8) which is movably arranged in its entirety with respect to the housing (2); and that the radial rotor positioner (11) comprises a first shape-changeable body (12), the first shape-changeable body (12) being configured to make contact with a non-rotating part of the radial bearing (8) with respect to the housing (2) and in that case to exert a force on this non-rotating part, in such a way that the radial bearing (8) in its entirety together with the rotor (3*a*, 3*b*) is shifted with respect to the housing (2).

7. The element according to claim 6, wherein the first shape-changeable body (12) encloses several first cavities (14) closed off or practically closed off from the internal chamber, which first cavities (14) are each at a first pressure, wherein, in a plane perpendicular to the rotor shaft (4*a*, 4*b*), a first (14*a*) of these first cavities (14) is situated directly opposite at least one second (14*b*) of these first cavities (14) with respect to the rotor shaft (4*a*, 4*b*), wherein the first shape-changeable body (12) is configured in such a way that, when the first pressure in said first (14*a*) of the first cavities (14) is increased, a volume of said first (14*a*) of the first cavities (14) is increased and the first pressure in the at least one second (14*b*) of the first cavities (14) is decreased in such a way that a volume of the at least one second (14*b*) of the first cavities (14) decreases, so that the rotor shaft (4*a*, 4*b*) in a radial direction with respect to the rotor shaft (4*a*, 4*b*) is shifted to the at least one second (14*b*) of the first cavities (14).

8. The element according to claim 7, wherein the radial rotor positioner (11) comprises an outer ring (15), an inner ring (16), and a space closed off or practically closed off from the internal chamber between the outer ring (15) and the inner ring (16), wherein the outer ring (15) is fixedly attached with respect to the housing (2) and the inner ring (16) is fixedly attached to the non-rotating part of the radial bearing (8) with respect to the housing (2), or vice versa, and wherein the radial rotor positioner (11) in the aforementioned space is provided with a spring structure (17) which is connected with the outer ring (15) on the one hand and with the inner ring (16) on the other hand in such a way that the aforementioned space is subdivided into multiple mutually closed-off or practically closed-off essentially ring segment-shaped compartments, each of these compartments serving as one of the aforementioned first cavities (14).

9. The element according to claim 1, wherein the separate yielding component (10) comprises an axial rotor positioner (18), configured in such a way that the rotor (3*a*, 3*b*) and the housing (2), with regard to the rotor shaft (4*a*, 4*b*), can be shifted axially with respect to each other.

10. The element according to claim 9, wherein at least one of the aforementioned bearings (7) is an axial bearing (9) which is movably arranged in its entirety with respect to the housing (2); and that the axial rotor positioner (18) comprises a second shape-changeable body (19), the second shape-changeable body (19) configured to make contact with a non-rotating part of the axial bearing (9) with respect to the housing (2) and in that case to exert a force on this non-rotating part, in such a way that the axial bearing (9) in its entirety together with the rotor (3*a*, 3*b*) is shifted with respect to the housing (2).

11. The element according to claim 10, wherein the second shape-changeable body (19) encloses a second cavity (20) closed off or practically closed off from the internal chamber, the second shape-changeable body (19) configured in such a way that an axial dimension of the second shape-changeable body (19) according to the rotor shaft (4*a*, 4*b*) increases or decreases when a second pressure in the second cavity (20) is increased or is decreased, respectively.

12. The element according to claim 1, wherein the separate yielding component (10) comprises a radially adaptable ring body (21) surrounding the rotor shaft (4*a*, 4*b*), wherein an outer perimeter (22) of the radially adaptable ring body (21) is fixedly attached with respect to the housing (2) and wherein the radially adaptable ring body (21) is configured in such a way that a radial external inner radius (23) of the radially adaptable ring body (21) according to the rotor shaft (4*a*, 4*b*) can be changed in size.

13. The element according to claim 12, wherein the aforementioned radially adaptable ring body (21) comprises a ring-shaped third shape-changeable body (24) that encloses a third cavity (25) closed off or practically closed off from the internal chamber, which third shape-changeable body (24) is configured in such a way that the radial external inner radius (23) according to the rotor shaft (4*a*, 4*b*) decreases or increases when a third pressure in the third cavity (25) is increased or decreased, respectively.

14. The element according to claim 1, wherein the internal chamber comprises a bore (26) according to a direction of the rotor shaft (4*a*, 4*b*).

15. The element according to claim 14, wherein the separate yielding component (10) comprises an axially adaptable body (27) which is attached to an end surface (28) of the bore (26), which axially adaptable body (27) has a first specific deformable shape configured to be able to seal or open an axial clearance according to the rotor shaft (4*a*, 4*b*) between the rotor (3*a*, 3*b*) and the end surface (28) in such a way that a first operating chamber in the internal chamber can be respectively isolated from or placed in fluid communication with a second operating chamber in the internal chamber.

16. The element according to claim 15, wherein the aforementioned axially adaptable body (27) comprises a fourth shape-changeable body (29) that encloses a fourth cavity (30) closed off or practically closed off from the internal chamber, which fourth shape-changeable body (29) is configured in such a way that an axial dimension of the fourth shape-changeable body (29) according to the rotor shaft (4*a*, 4*b*) increases or decreases when a fourth pressure in the fourth cavity (30) is increased or decreased, respectively.

17. The element according to claim 14, wherein the separate yielding component (10) comprises a radially adaptable body (31) attached to a surface of revolution (32) of the bore (26), which radially adaptable body (31) has a second specific deformable shape configured to be able to seal or open a radial clearance according to the rotor shaft (4*a*, 4*b*) between the rotor (3*a*, 3*b*) and the surface of revolution (32) in such a way that a third operating chamber in the internal chamber can be respectively isolated from or placed in fluid communication with a fourth operating chamber in the internal chamber.

18. The element according to claim 17, wherein the aforementioned radially adaptable body (31) comprises a fifth shape-changeable body (33) that encloses a fifth cavity (34) closed off or practically closed off from the internal chamber, which fifth shape-changeable body (33) is configured in such a way that a radial dimension of the fifth shape-changeable body (33) according to the rotor shaft (4*a*, 4*b*) increases or decreases when a fifth pressure in the fifth cavity (34) is increased or decreased, respectively.

19. The element according to claim 1, wherein the element (1) comprises mechanical, hydraulic and/or pneumatic means for positionally adjusting the positionally adjustable part with respect to the housing (2).

20. The element according to claim 1, wherein the element (1) comprises a controller for driving the positionally adjustable part.

21. A device for compressing or expanding a gas comprising an element (1) according to claim 1.

22. A method for controlling an element for compressing or expanding a gas, the element (1) comprising:

a rigid housing (2) containing an internal chamber;

a rotor (3*a*, 3*b*) situated in the internal chamber and comprising a rotor shaft (4*a*, 4*b*); and one or more bearings (7) in which the rotor shaft (4*a*, 4*b*) of the rotor (3*a*, 3*b*) is bearing-supported, the rotor (3*a*, 3*b*) with its rotor shaft (4*a*, 4*b*) being rotatably mounted with respect to the housing (2) by means of these bearings (7), wherein the rotor (3*a*, 3*b*) is mounted with one or more clearances with respect to a wall (5) of the internal chamber, wherein the method comprises the step of acting upon at least one of the clearances by positionally adjusting a positionally adjustable part of a separate yielding component (10) of the element (1) with respect to the housing (2), wherein a fixed part of the separate yielding component (10) is held in a fixed or practically fixed position with respect to the housing (2), and wherein the separate yielding component is (10) is not directly attached to the rotor (3*a*, 3*b*).

23. The method according to claim 22, wherein a bearing of the one or more bearings (7) is movably arranged in its entirety with respect to the housing (2); and that, upon acting upon at least one of the clearances, the positionally adjustable part makes contact with a non-rotating part of said bearing with respect to the housing (2) and in that case exerts a force on said non-rotating part, in such a way that the bearing in its entirety together with the rotor (3*a*, 3*b*) is shifted with respect to the housing (2).

24. The method according to claim 22, wherein the positionally adjustable part respectively moves into or out of at least one of the clearances, in such a way that the at least one of the clearances is sealed or opened by the positionally adjustable part.

25. The method according to claim 22, wherein the element (1) comprises multiple rotors (3*a*, 3*b*), said multiple rotors (3*a*, 3*b*) being mounted with a mutual clearance in such a way that by the rotors (3*a*, 3*b*) in the internal chamber one or multiple, practically mutually closed-off operating chambers are formed, and wherein the method comprises the step of changing the size of the mutual clearance by positionally adjusting the positionally adjustable part with respect to the housing (2).

26. The method according to claim 22, wherein at least one of the aforementioned clearances is controlled when the element (1) is not in operation and/or is controlled on a predefined value before said element (1) is put into operation.

27. The method according to claim 22, wherein at least one of the aforementioned clearances is controlled when the element (1) is in operation.

28. The method according to claim 22, wherein positionally adjusting the positionally adjustable part with respect to the housing (2) is done mechanically, hydraulically and/or pneumatically.

* * * * *